US006761936B1

(12) United States Patent
Reifferscheid et al.

(10) Patent No.: US 6,761,936 B1
(45) Date of Patent: Jul. 13, 2004

(54) METHOD AND INSTALLATION FOR HOT DIP GALVANIZING HOT ROLLED STEEL STRIP

(75) Inventors: Markus Reifferscheid, Ratingen (DE); Rolf Brisberger, Issum (DE)

(73) Assignee: SMS Demag AG, Düsseldorf (DE)

( * ) Notice: Subject to any disclaimer, the term of this patent is extended or adjusted under 35 U.S.C. 154(b) by 0 days.

(21) Appl. No.: 10/049,261

(22) PCT Filed: Aug. 4, 2000

(86) PCT No.: PCT/EP00/07582

§ 371 (c)(1),
(2), (4) Date: May 9, 2002

(87) PCT Pub. No.: WO01/11099

PCT Pub. Date: Feb. 15, 2001

(30) Foreign Application Priority Data

Aug. 6, 1999 (DE) ..... 199 37 216
Sep. 10, 1999 (DE) ..... 199 43 238

(51) Int. Cl.[7] ..... B05D 1/18; B05D 3/04; B05D 3/10

(52) U.S. Cl. ..... 427/433; 427/319; 427/321; 427/329; 427/431

(58) Field of Search ..... 427/431, 433, 427/319, 321, 329; 118/419, 429, 66, 67, 68

(56) References Cited

U.S. PATENT DOCUMENTS 4,143,184 A 3/1979 Paulus et al.
4,643,131 A 2/1987 Umeda et al.
4,814,210 A * 3/1989 Ackermann et al. ..... 427/433
5,284,680 A * 2/1994 Bilimoria ..... 427/307
5,677,005 A * 10/1997 Isobe et al. ..... 427/319
5,976,272 A * 11/1999 Seidel et al. ..... 148/261
6,159,622 A * 12/2000 Hori et al. ..... 428/659

FOREIGN PATENT DOCUMENTS

WO 8300885 3/1983

* cited by examiner

*Primary Examiner*—Michael Barr
(74) *Attorney, Agent, or Firm*—Friedrich Kueffner

(57) ABSTRACT

A method for hot dip galvanizing of hot-rolled steel strip, wherein in a first method step, the strip (50) is introduced into a pickling station (10–13) and a layer of scale and reaction products are removed from the strip surface in the pickling station. In another method step, the strip (50) is introduced into a rinsing station (21–23) and residues of the pickle and pickling products are removed from the strip surface in the rinsing station, and subsequently the strip is introduced into a drying station and is dried. And from there, in another method step, the strip is introduced into a furnace (40) and is adjusted to galvanizing temperature under a protective gas atmosphere. In a last method step, the strip is guided through a galvanizing bath and the surface of the (50) is coated with a hot dip galvanizing layer in the galvanizing bath, wherein the strip temperature in the furnace (40) is adjusted at most to 50° K. above immersion temperature of the strip (50) into the zinc bath.

3 Claims, 1 Drawing Sheet

METHOD AND INSTALLATION FOR HOT DIP GALVANIZING HOT ROLLED STEEL STRIP

BACKGROUND OF THE INVENTION

1. Field of the Invention

The invention relates to a method and an installation for hot dip galvanizing of hot-rolled steel strip, wherein, in a first method step, the strip is introduced into a pickling station and a layer of scale and reaction products are removed from the strip surface in the pickling station. In a second method step, the strip is introduced into a rinsing station and residues of the pickle and pickling products are rinsed from the strip surface in the rinsing station, and subsequently, the strip is introduced into a drying station and is dried in the drying station. From the drying station, the strip is introduced into a furnace in another method step and is adjusted to galvanizing temperature in the furnace under a protective gas atmosphere. In a last method step, the strip is guided through a galvanizing bath and the surface of the strip is coated in the galvanizing bath with a hot dip galvanizing layer.

2. Description of the Related Art

Hot dip coating, particularly hot dip galvanizing, of hot-rolled steel strip, so called hot strip, is becoming economically increasingly more important as compared to conventional cold strip hot dip galvanizing. As a result of the development of thin slab technology in hot-rolled strip, there is the technical possibility of producing hot strips in the thickness range of below 1.2 mm from casting heat. There is the additional possibility to substitute cold strip for comparatively inexpensive hot strip in dependence on the requirements of the customer.

Different methods and installations for hot dip coating, particularly hot dip galvanizing, of steel strip are known. They are predominantly types of installation in which cold-rolled strips are used.

In such installations, the actual coating process is preceded by an annealing furnace in which a structural transformation takes place at high temperatures for obtaining the desired mechanical properties. The existing temperature difference between the melt bath, preferably zinc or zinc alloys, and the maximum strip temperature may be up to 400° C. However, hot dip galvanizing cannot be carried out with this overheated strip, so that the strip must be cooled prior to coating to temperatures close to the melt bath temperature.

In contrast, hot strip or preheated cold strip do not require annealing for influencing the mechanical properties; rather, the strip temperature is merely adjusted to that of the melt bath in order to achieve the desired reaction of the steel strip surface with the alloying components of the melt bath. In contrast, high temperature annealing is frequently disadvantageous for the mechanical properties of the strip.

The present invention relates exemplary exclusively to the various methods of hot strip hot dip refining or hot strip hot dip galvanizing.

The desired temperature level, particularly for hot strip hot dip galvanizing, is in the previously operated installations for hot dip galvanizing still always higher than the required 450° C. of the zinc bath. The reason for this is the required removal of all oxidation products and their prior stages from the steel strip surface. Oxidation products are inevitably produced in the transition area from the pickling stage through the rinsing and drying stage into the furnace entrance due to the influence of ambient oxygen. The quantity and formation of the oxidation products entering the furnace and the ambient oxygen entrained by the strip determine the necessary method parameters of the treatment procedure, characterized by a required reduction potential, temperature level and holding time. The temperature level which is used is frequently so high that the strip must be additionally cooled prior to entering the zinc bath.

Another method of operation is characterized by a significant increase of the temperature level in the zinc bath to values above 460° C. A particular disadvantage of this type of method is the increased production of zinc-containing slag. On the one hand, this leads to increased material and operating costs for the zinc bath and, on the other hand, to a reduced quality of the strip.

SUMMARY OF THE INVENTION

Starting from the prior art mentioned above, the invention is based on the object of providing a method and a hot strip hot dip galvanizing installation which overcome the disadvantages and difficulties discussed above and produce hot dip galvanized steel strip having a high and defect-free surface quality with an economical amount of material and operating costs.

For meeting this object, the invention proposes to adjust the strip temperature in the furnace at most to 50° K. above immersion temperature in the zinc bath.

The $H_2$ concentration in the furnace is advantageously adjusted to at most 20% and preferably to less than 5%. It is useful to carry out the method steps between the last rinsing stage of the rinsing station through the drying station up to the entrance of the heating furnace hermetically screened from the ambient oxygen from the surroundings.

Consequently, an installation for carrying out the method according to the invention provides that the outlet of the last rinsing stage of the rinsing station is connected to the inlet of the drier and the outlet of the drier is connected to the inlet of the furnace by locks and are hermetically sealed from the ambient atmosphere.

Additional useful further developments of the method and of the hot dip galvanizing installation for hot strip are provided in accordance with the features of subclaims.

The method and the installation according to the invention advantageously ensure that the optimum surface condition of the strip achieved after passing the strip through the pickling station and the rinsing station is preserved in the subsequent drying stage as well as during the transition in the furnace areas and from the furnace into the galvanizing bath.

This is achieved by:

- the above-mentioned adjustment of the temperature of the strip in the furnace,
- direct coupling of at least the last rinsing stage of the rinsing station through the drying stage with the furnace inlet while screening ambient oxygen,
- application of a water-binding medium, preferably $NH_3$, or a solution thereof, onto the strip in the rinsing stage, wherein subsequently in the drying stage the water-binding medium can be removed from the strip quickly and without residue, i.e., without the introduction of oxygen or liquid cleaning medium,
- alternatively by operating the drying stage with an atmosphere which has a reducing effect, for example, a $N_2$ $H_2$ gas mixture.

As a result of the measures mentioned above, the optimum strip condition is preserved after pickling up into the furnace and an optimum adjustment of the strip temperature when it is immersed into the zinc bath is achieved. The entrance of oxygen and the attendant surface reactions, particularly oxidation, are prevented. This makes it possible to operate the furnace at temperatures in the range of the melt bath temperature. An overheating of the strip and a prolongation of the holding time in the furnace do not take place. A strip cooler is not necessary. The manner of operation according to the invention and the corresponding installation generally make possible a substantially more compact construction of the furnace element and lower investment and operating costs. Simultaneously, it is possible to operate the furnace with low $H_2$ contents in the protective gas. The disadvantages of the conventional methods mentioned above with increased zinc bath temperature are advantageously eliminated.

This is because, in accordance with the invention, the strip is adjusted to a temperature which is at most 50° K. higher than the immersion temperature in the zinc bath.

Additional details, features and advantages of the invention result from the following explanation of an embodiment which is schematically illustrated in the drawings.

DETAILED DESCRIPTION OF THE PREFERRED EMBODIMENTS

Figure 1:
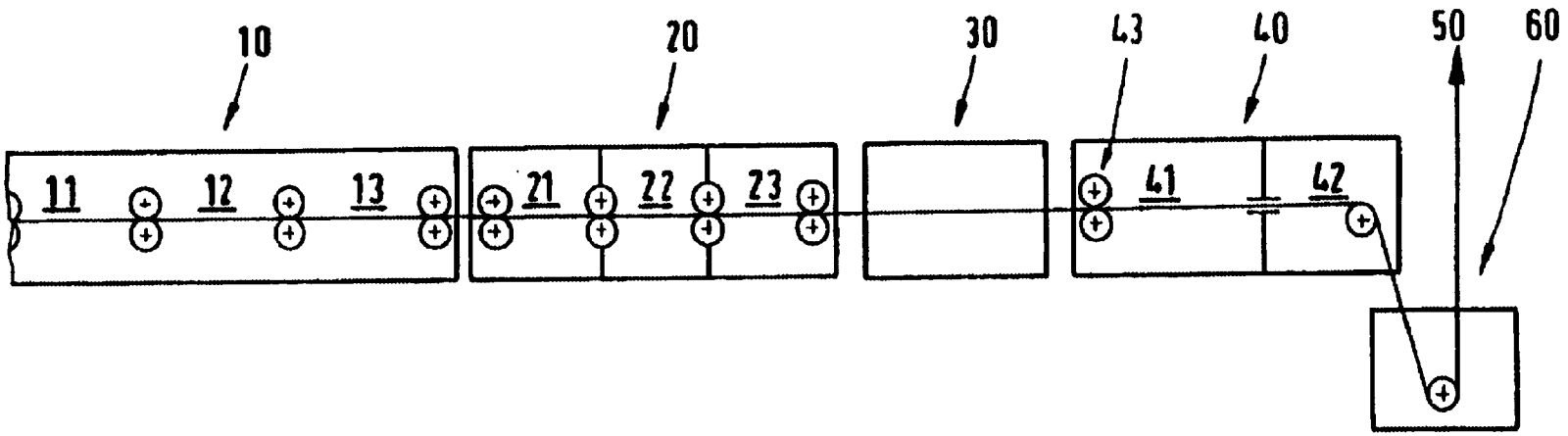
FIG.1 PRIOR ART
FIG. 1 shows a layout of a hot dip galvanizing installation according to the prior art.

In accordance with the layout of a conventional hot dip galvanizing installation shown in FIG. 1, a strip 50 is introduced in a first method step into a pickling station 10 with three pickling stages 11 to 13 and a layer of scale as well as reaction products are removed from the strip surface in the pickling station. Pickling is usually carried out in the pickling station 10 or in the pickling stages 11, 12, 13 by means of hydrochloric acid (HCl).

Figure 2:
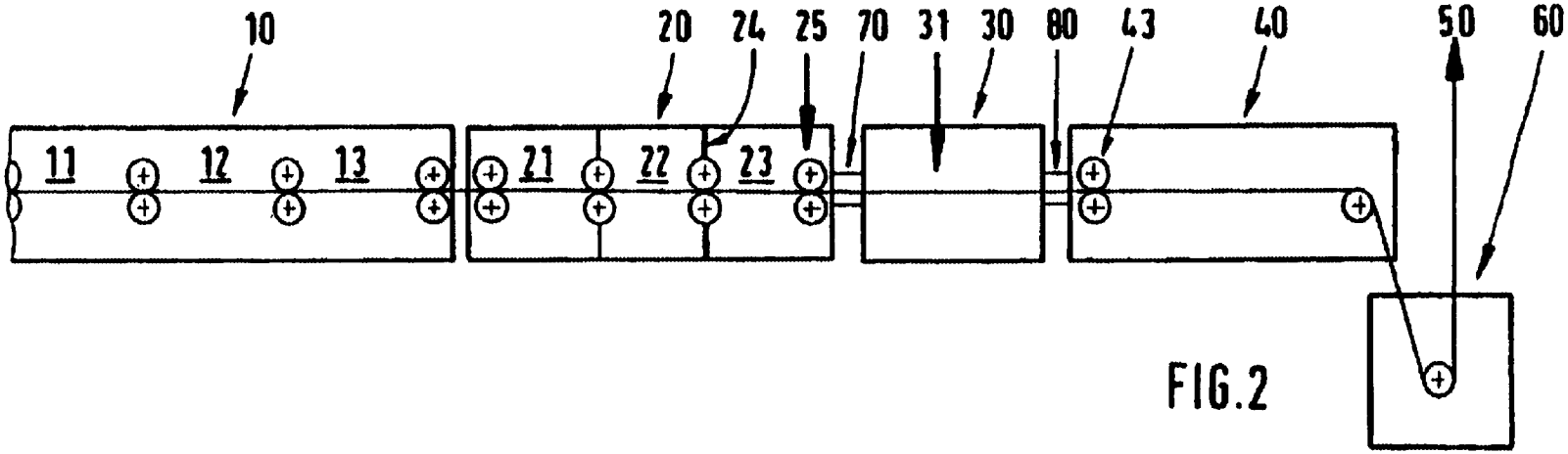
FIG. 2 shows a layout of a hot dip galvanizing installation according to the invention.

In the subsequent method step, the strip 50 is introduced into the rinsing station 20 with the rinsing stages 21 to 23 and residues of the pickle and pickling products are removed in the rinsing station from the strip surface. Subsequently, the strip is introduced into and dried in the drying station 30. From the drying station, the strip 50 is introduced in another method step into a furnace 40 which comprises a preheating stage 41 and an integrated heating stage 42 and the strip is heated in the furnace to galvanizing temperature preferably under a protective gas atmosphere. In a last method step, the strip is guided through a galvanizing bath. In the galvanizing bath, the surface of the strip 50 is coated with a hot dip galvanizing layer. In contrast to the conventional galvanizing installation according to FIG. 1, in accordance with the layout according to the invention of the hot dip galvanizing installation according to FIG. 2, the method steps between the last rinsing stage 23 of the rinsing station 20 through the drying station 30 up to the inlet 43 of the heating furnace 40 are carried out while being hermetically screened from the ambient oxygen from the surroundings.

By expanding the rinsing station 20 by a rinsing stage 23 or by screening the rinsing stage 23 by means of a separating wall 24 from the preceding rinsing stations 21, 22, a water-repellent or water-binding medium 25 is introduced into the rinsing stage 23. The medium used may be, for example, $NH_3$ or a solution of $NH_3$.

A preferred development of the method provides that rinsing of the strip 50 in the rinsing station 20 is carried out in the first stages 21 and 22 with deionized water and in the third stage 23 with the addition of $NH_3$ as a drying medium.

Drying of the strip 50 in the drying station 30 takes place without the supply of air. In accordance with the invention, drying is carried out by means of thermal radiation with the addition of a mixture of nitrogen, hydrogen and ammonia gas ($N_2/NH_3$) or $H_2$.

The drying station 30 is hermetically closed off against the entrance of ambient oxygen on both sides by means of locks 70, 80 adjacent the stations 20 and 40. The outlet of the last rinsing stage 23 of the rinsing station 20 is connected to the inlet of the drying station 30 and the outlet of the drying station 30 is connected to the inlet 43 of the heating furnace 40 through locks 70, 80, and they are hermetically sealed from the ambient atmosphere.

The measures according to the invention maintain the optimum strip condition after pickling up to the heating furnace because the introduction of ambient oxygen is prevented. Consequently, as can be seen in the illustration of the heating furnace 40 in FIG. 2, the construction of the furnace can be simplified and realized with lower investment and operating costs because of the lower necessary heating power and the omission of the cooling stretch. In addition, the furnace operation is possible with comparatively low $H_2$ contents in the protective gas.

What is claimed is:

1. Method for hot dip galvanizing of hot-rolled steel strip, wherein:

in a first method step, the strip (50) is introduced into a pickling station (10–13) and a layer of scale and reaction products are removed from the strip surface in the pickling station, in another method step, the strip (50) is introduced into a rinsing station (21–23) and residues of the pickle and pickling products are removed from the strip surface in the rinsing station, and subsequently the strip is introduced into a drying station and is dried, and from there in another method step, the strip is introduced into a furnace (40) and is adjusted to galvanizing temperature under a protective gas atmosphere, and in a last method step, the strip is guided through a galvanizing bath and the surface of the strip (50) is coated with a hot dip galvanizing layer in the galvanizing bath, wherein the strip temperature in the furnace (40) is adjusted at most to 50° K. above immersion temperature of the strip (50) into the zinc bath, wherein a water-repellent or water-binding medium (25) which wets the strip (50) is introduced into the last rinsing stage (23) of the rinsing station (20).

2. Method according to claim 1, wherein the medium (25) introduced into the third rinsing stage (23) is $NH_3$ or a solution containing $NH_3$.

3. Method according to claim 1, wherein drying of the strip (50) in the drying station (30) is carried out without the supply of air from the outside by means of heat radiation with the addition of a mixture of nitrogen, hydrogen and ammonia gas $(N_2/NH_3)+H_2$ or another mixture of two of the mentioned gases.

* * * * *